US005285361A

United States Patent [19]

McKillip

[11] Patent Number: 5,285,361

[45] Date of Patent: Feb. 8, 1994

[54] BACKLIGHTING APPARATUS FOR FLAT PANEL DISPLAYS

[75] Inventor: Robert C. McKillip, Cedar Rapids, Iowa

[73] Assignee: Rockwell International Corporation, Seal Beach, Calif.

[21] Appl. No.: 935,629

[22] Filed: Aug. 25, 1992

[51] Int. Cl.[5] ..... A47F 11/10; F11S 5/00

[52] U.S. Cl. ..... 362/125; 362/29; 362/216; 362/347

[58] Field of Search ..... 362/29, 30, 125, 216, 362/310, 347; 40/564, 575

[56] References Cited

U.S. PATENT DOCUMENTS

| | | | |
|---|---|---|---|
| 1,858,755 | 5/1932 | Wyck et al. | 40/564 |
| 2,234,115 | 3/1941 | Griggs | 362/216 |
| 2,495,912 | 1/1950 | Wood | 362/30 |
| 3,202,813 | 8/1965 | Weinstein | 362/223 |
| 3,453,425 | 7/1969 | Whitaker | 362/216 |
| 3,643,078 | 2/1972 | Lewis | 362/216 |
| 3,806,722 | 4/1974 | Peake et al. | 362/125 |
| 3,997,991 | 12/1976 | Hayman-Chaffey et al. | 40/564 |
| 4,335,421 | 6/1982 | Modia et al. | 362/125 |
| 4,493,013 | 1/1985 | Hawkins | 362/216 |
| 4,766,524 | 8/1988 | Ogawa et al. | 362/216 |

FOREIGN PATENT DOCUMENTS

| | | | |
|---|---|---|---|
| 479447 | 6/1929 | Fed. Rep. of Germany | 40/564 |
| 1029880 | 6/1953 | France | 40/564 |
| 1511003 | 12/1967 | France | 40/564 |

*Primary Examiner*—Ira S. Lazarus
*Assistant Examiner*—Y. Quach
*Attorney, Agent, or Firm*—Kyle Eppele; M. Lee Murrah; H. Fredrick Hamann

[57] ABSTRACT

An apparatus for providing illumination to flat panel displays having a multi-walled encasement device, lighting means and a flat panel display. The multi-walled encasement device may be of a variety of shapes and serves to support the lighting means within the cavity formed by its walls. The fluorescent bulb is fabricated into a circular design and placed within the multi-walled encasement device thereby providing uniform light intensity across the flat panel display attached to the encasement device. The encasement device may contain convex or concave contouring to better direct or concentrate light wave intensity to the flat panel display.

12 Claims, 1 Drawing Sheet

BACKLIGHTING APPARATUS FOR FLAT PANEL DISPLAYS

BACKGROUND OF THE INVENTION

The invention relates to flat panel displays, and more particularly to illumination for such flat panel displays.

Flat panel displays are widely used in applications where the depth dimension of a cathode ray tube is determined to be excessive. A variety of flat panel display technologies have emerged each having unique advantages. Plasma panel, electrochromism, colloidal suspension, gas discharge and liquid crystallinity are but some of the emissive and non-emissive technologies used by flat panel display manufacturers. Non-emmissive flat panel displays, such as liquid crystal displays (LCDs) require a light source especially in low light or night usage. One such application that is becoming increasingly common is aircraft cockpit displays for avionics equipment. Although not constrained to avionic LCD applications the present invention will be described in terms of such usage. It is understood that the teachings of the present invention are not limited to avionic LCD applications but may be utilized by any flat panel display using backlighting.

The principle of operation of LCD's is well known in the art but for purposes of understanding the background of the present invention, it can be stated that LCD's operate by reducing the transmissibility of light through a thin layer of a liquid crystalline material when an electric field is applied. Since the effect is localized, shapes and characters can be drawn on an LCD by carefully controlling the application of the electric field. Unlike cathode ray tubes which LCD's are replacing, LCD's are not self-illuminating. Therefore, some sort of backlighting is required in order for LCD's to be viewed.

Backlighting is conventionally accomplished by locating a fluorescent lamp device in a sealed cavity directly behind the LCD. The fluorescent lamp is generally comprised of an elongated bulb which may be "U", "N" or "M" shaped, as known in the prior art. The shape of the light source bears direct impact upon the light intensity across the LCD and just as importantly, inherent "dark spots" or areas of lower light intensity. Typically dark spots occur in close proximity to open locations in any given lighting configuration. For example, the top portion of the "U", formed by the gap between the upright members, would be an inherent dark spot in applications using such a U shaped bulb.

Accordingly, an apparatus for illuminating LCD applications of uniform or near uniform intensity across the entire viewing panel would be a significant improvement for such applications. The present invention discloses a variety of embodiments of such apparatus.

SUMMARY OF THE INVENTION

A circular shaped fluorescent lighting configuration that may be used with or without contoured lighting encasing that offers improved flat panel display illumination. The circular shaped lighting unit provides near uniform light intensity across the display by taking advantage of lower light intensity by bending the entire tube length at the time the light tube was formed. Additionally, an encasing mechanism larger in size in length and width than the display to be illuminated is also disclosed that contains additional contoured shaped reflective surfaces to increase the upward light intensity. The increased encasing dimensions also allows the use of a larger diameter fluorescent bulb.

It is therefore an object of the present invention to provide an apparatus for providing uniform and increased intensity lighting for flat panel display applications.

It is a feature of the present invention to provide a backlighted flat panel display application having a circular shaped lighting tube thereby eliminating prior art dark spots.

It is an additional feature of the present invention to provide a backlighted flat panel display application having a lighting encasement contoured in such a manner as to allow large diameter fluorescent tube to serve as the display light source.

It is an advantage of the present invention to provide a backlighted flat panel display application having near uniform lighting intensity across the display application.

It is another advantage of the present invention to provide a backlighted flat panel display application having fewer manufacturing Process steps and associated lower costs.

Other objects, features and advantages of the present invention will become apparent from the following disclosure.

DETAILED DESCRIPTION OF THE DRAWINGS

Figure 1:
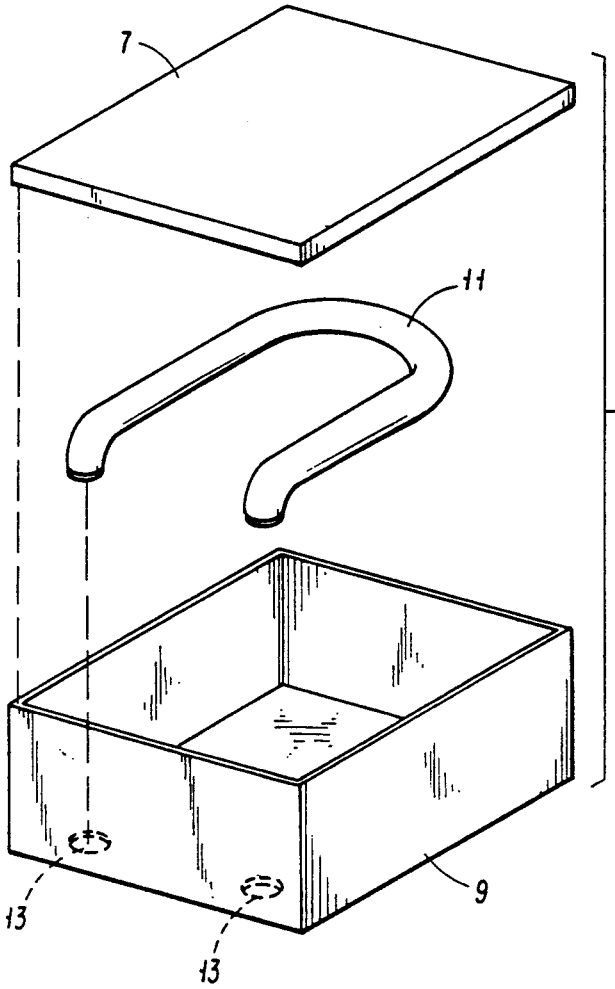
FIG. 1 PRIOR ART
FIG. 1 is an exploded orthogonal view of the prior art technique of providing flat panel display backlighting.

Referring now to the drawings wherein like items are referenced as such throughout, FIG. 1 illustrates an exploded isometric view of a representative flat panel assembly 5 as known in the prior art. A flat panel display, such as a liquid crystal display or LCD, serves as a top member for assembly 5. A multi-walled encasement 9, shown in FIG. 1 as a rectangular shaped structure, surrounds and supports fluorescent bulb 11. Encasement 9 is shown with opening 13 for accommodating electrical connections to bulb 11. The assembly may be held in place by a combination of adhesives, clips, screws or other suitable fastener means, as well known in the prior art.

The "U" shaped design of bulb 11 requires three separate bending steps during the fabrication process, each step composed of heating, bending and cooling. The bending is Performed at each open end of bulb 11 to direct the terminating ends through opening 13 and in forming the lower curved portion of the "U" shape of bulb 11. Display 7 suffers from lower light intensity in the general region located slightly offset the open portions of bulb 11. These low level light intensity areas or "dark spots" are the results in part of emmissive material coating on tube 11 thinning during the fabrication cycle.

Figure 2:
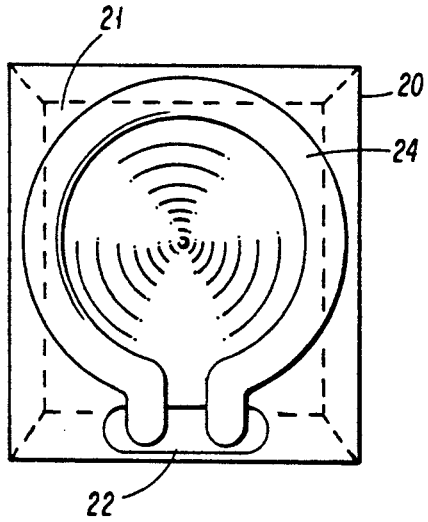
FIG. 2 is a top plan view of one embodiment of the present invention.

FIG. 2 illustrates a top plan view of one embodiment of the present invention. A multi-walled encasement 20, is shown as being square shaped and having a bottom member 21 with an opening 22. A circular shaped fluorescent bulb 24 is contained within encasement 20 and has its electrical connections and ends directed through opening 22. It is understood that a flat panel display having length and width dimensions consistent with the bottom member 21 would be assembled as a top to encasement 20, although such display is not shown in FIG. 2.

In order to provide near uniformity of light to the companion display the diameter of bulb 24 may be derived by the equal area method described as follows:

where $A_1$=the cross sectional area of the bottom encasement member, circumscribed by the bulb 24;

$A_2$=the area of the bottom encasement member described between the outer edge of bulb 24 and the vertical walls of encasement assembly 20.

The area of $A_1$ is found by the following equation:

$$A_1 = L * W - \pi(R + D/2)^2$$

where,

L=Length of bottom encasement member

W=Width of bottom encasement member

R=Radius from center of interior area circumscribed by the bulb to center of the bulb D=Bulb diameter Similarly A2 may be determined by the following relationship:

$$A_2 = \pi(R - D/2)^2$$

Solving for R by equating $A_1$ to $A_2$ utilizing the above formulae allows one the opportunity to adjust any of the variables, length, width, radius or diameter, and determine the corresponding modifications to the dependent variables.

Figure 3:
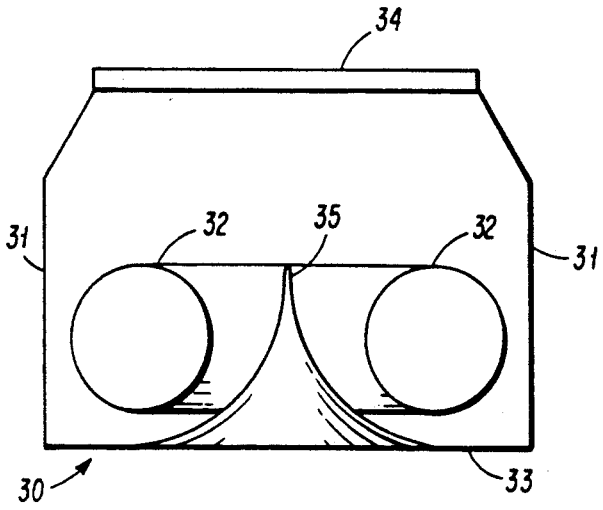
FIG. 3 is a cross-section view of a second embodiment of the present invention.

FIG. 3 illustrates a cross-sectional view of an alternate embodiment of the present invention. A multi-walled encasement 30 is shown enclosing and supporting a circular fluorescent bulb 32 which illuminates a flat panel display 34. As shown encasement 30 is comprised of four vertical members 31 (two of which are not shown) and bottom member 33. Each vertical member 31 has its portion nearest to display 34 acutely angled towards the display perimeter in such a manner so as to form an opening defining a flat panel display size smaller in length and width than bottom member 33. The inward sloping portion of members 31 provides increased reflected light towards the region illuminating display 34 and allows for use of a larger diameter bulb than would otherwise be possible. A larger diameter bulb offers longer bulb life and increased illumination intensity of the flat panel display.

It should also be noted that member 33 may have a conical protrusion 35 within the inside diameter of bulb 32 and extending towards the flat panel display. Cone 35 directs light towards display 34 with a minimum number of reflections. Although not shown, it is also understood that additional contouring of encasement 30 is possible so as to focus light generally or specifically to a localized region of display 34 as desired by the specific application of the display information. Use of contouring with cone 35 and circular bulb 32 is especially advantageous for flat panel displays that are used to illuminate circular pattern data, such as an aircraft heading indicator.

It is equally understood that the entire interior surface of encasement 20 and 30 may be coated with very high gloss white paint to enhance the reflective capabilities of the encasement and thus increase light intensity to the respective display.

While particular embodiments of the present invention have been shown and described, it should be clear that changes and modifications may be made to such embodiments without departing from the true scope and spirit of the invention. It is intended that the appended claims to cover all such changes and modifications.

I claim:

1. An apparatus for illuminating a flat panel display comprising:

a multi-walled encasement device having a bottom member and a plurality of vertical walls thereby forming a cavity within the multi-walled encasement device;

a lighting source of circular configuration supported by and contained within the multi-walled encasement device;

a flat panel display serving as a top member to the multi-walled encasement device; and the bottom member having a cross sectional area circumscribed by the lighting source which is equal in size to an area defined by the perimeter of the bottom member and the outer edge of the lighting source.

2. The apparatus of claim 1 wherein the lighting source is a fluorescent bulb having a round cross-section construction.

3. The apparatus of claim 1 wherein the multi-walled encasement device has its surfaces coated with material highly reflective of light.

4. The apparatus of claim 1 wherein the multi-walled encasement device is of square design.

5. The apparatus of claim 1 wherein the flat panel display is of non-emissive technology construction.

6. The apparatus of claim 1 further comprising a conical protrusion integral to the multi-walled encasement device extending from the bottom member through an area circumscribed by the light source thereby increasing intensity and direction of light waves to the flat panel display.

7. An apparatus for illuminating a flat panel display comprising:

a multi-walled encasement device having a bottom member and a plurality of vertical walls thereby forming a cavity within the multi-walled encasement device;

a lighting source of circular configuration supported by and contained within the multi-walled encasement device; and a flat panel display serving as a top member to the multi-walled encasement device;

wherein the bottom member length and width dimensions exceed the length and width dimensions of the flat panel display;

the vertical walls of the multi-walled encasement device each has its upper portion sloped towards the center of the multi-walled encasement device such that the flat panel display may serve as a sealing top member to the multi-walled encasement device and the multi-walled encasement device may accommodate a larger lighting source than a multi-walled encasement device lacking similarly sloped vertical members; and wherein the bottom member has a cross sectional area circumscribed by the lighting source which is equal in size to an area defined by the perimeter of the bottom member and the outer edge of the lighting source.

8. The apparatus of claim 7 wherein the lighting source is a fluorescent bulb having a round cross section construction.

9. The apparatus of claim 7 wherein the multi-walled encasement device has its surfaces coated with material highly reflective of light.

10. The apparatus of claim 7 wherein the multi-walled encasement device is of square design.

11. The apparatus of claim 7 wherein the flat panel display is of non-emmissive technology construction.

12. The apparatus of claim 7 further comprising a conical protrusion integral to the multi-walled encasement device extending from the bottom member through an area circumscribed by the light source thereby increasing intensity and direction of light waves to the flat panel display.

* * * * *